United States Patent [19]

Engelfried et al.

[11] Patent Number: 4,574,596

[45] Date of Patent: Mar. 11, 1986

[54] STITCH-FORMING MACHINE

[75] Inventors: Werner Engelfried, Sindelfingen; Gerhard Müller, Esslingen, both of Fed. Rep. of Germany

[73] Assignee: Terrot Strickmaschinen GmbH, Stuttgart, Fed. Rep. of Germany

[21] Appl. No.: 617,682

[22] Filed: Jun. 6, 1984

[30] Foreign Application Priority Data

Jun. 14, 1983 [DE] Fed. Rep. of Germany ..... 3321385

[51] Int. Cl.[4] ..... D04B 15/06; D04B 15/14

[52] U.S. Cl. ..... 66/104; 66/106; 66/115

[58] Field of Search ..... 66/104, 106, 107, 115

[56] References Cited

U.S. PATENT DOCUMENTS

| | | | |
|---|---|---|---|
| 265,296 | 10/1882 | Adgate | 66/104 X |
| 575,012 | 1/1897 | Sturgess | 66/104 |
| 2,135,187 | 11/1938 | Lawson et al. | 66/115 |
| 3,176,479 | 4/1965 | Noll | 66/115 |
| 3,913,356 | 10/1975 | Suppe | 66/115 X |
| 4,532,781 | 8/1985 | Buck | 66/104 |

FOREIGN PATENT DOCUMENTS

| | | | |
|---|---|---|---|
| 2460868 | 7/1976 | Fed. Rep. of Germany | 66/106 |
| 2642079 | 3/1978 | Fed. Rep. of Germany | 66/106 |

*Primary Examiner*—Wm. Carter Reynolds
*Attorney, Agent, or Firm*—Shenier & O'Connor

[57] ABSTRACT

A stitch-forming machine which has needles guided on a needle support for displacement in the longitudinal direction and controlled by needle cams and also has holding-down and knocking-over sinkers which are adapted for displacement between the needles in the region of their heads and are moved by sinker cams in the longitudinal and transverse directions relative to the needle support. In order to guide the needles and sinkers so that they are laterally stable and to be able to operate them quietly and using relatively little power, it is suggested that the sinkers be composed of a push sinker adapted for displacement solely in the longitudinal direction and a holding-down and knocking-over sinker articulatedly connected to the push sinker and adapted for displacement in both the longitudinal and transverse directions, that the needles and push sinkers be commonly guided between webs on the needle support means, the needles thereby resting against the backs of the push sinkers, and that the pivot connection between the push sinker on the one hand and the holding-down and knocking-over sinker on the other be designed and arranged such that the holding-down and knocking-over sinker is disposed between the needles in the region of their heads.

4 Claims, 6 Drawing Figures

STITCH-FORMING MACHINE

The invention relates to a stitch-forming machine which has needles guided on a needle support means for longitudinal displacement and controlled by needle cams and also has holding-down and knocking-over sinkers which are displaceable between the needles in the region of their heads and are moved by sinker cams in the longitudinal and transverse directions relative to said needle support means.

The holding-down and knocking-over sinkers of known machines of this type (U.S. Pat. No. 4,532,781) are also moved, during stitch formation, lengthwise on the needle support means contrary to drawing movement of the needles so that the distance to be travelled by the needles during drawing is correspondingly shorter. Since the curve of the needle cam guideway formed by the needle cams may then be designed somewhat flatter, it is possible considerably to increase the knitting speed or the number of systems (feed stations), when the needle cam curves have the same angle of inclination, or a favourable compromise may be found between the angle of inclination and the number of systems. The sinkers of these machines are, furthermore, displaceable in a transverse direction relative to the associated needles in order to guide the sinkers into the cast-off or knocking-over position and then back into their initial position when the needles are driven out. During transverse displacement of the sinkers, their throats hold down the semifinished course and prevent the knitted fabric from being taken up when the needles are driven out again.

The sinkers of the known machines form at the same time lateral guide webs for the needle shafts. This causes a great deal of friction and a high level of noise and makes considerable drive power necessary. In addition, the known needle-sinker arrangement has very little lateral stability because the needles are guided to the side of the sinkers which are also movable.

The object of the invention is to improve a machine of the type in question such that the needles and sinkers are guided so as to be laterally stable, may be driven with relatively little power and are quiet in operation.

This object is accomplished according to the invention in that a. the sinkers are composed of a push sinker adapted for displacement solely in the longitudinal direction and a holding-down and knocking-over sinker articulatedly connected to this push sinker and adapted for displacement in both the longitudinal and transverse directions, that b. the needles and push sinkers are commonly guided between stationary webs on the needle support means, the needles thereby resting against the backs of the push sinkers, and that c. the pivot connection between the push sinker on the one hand and the holding-down and knocking-over sinker on the other is designed and arranged such that the holding-down and knocking-over sinker is disposed between the needles in the region of their heads.

Figure 1:
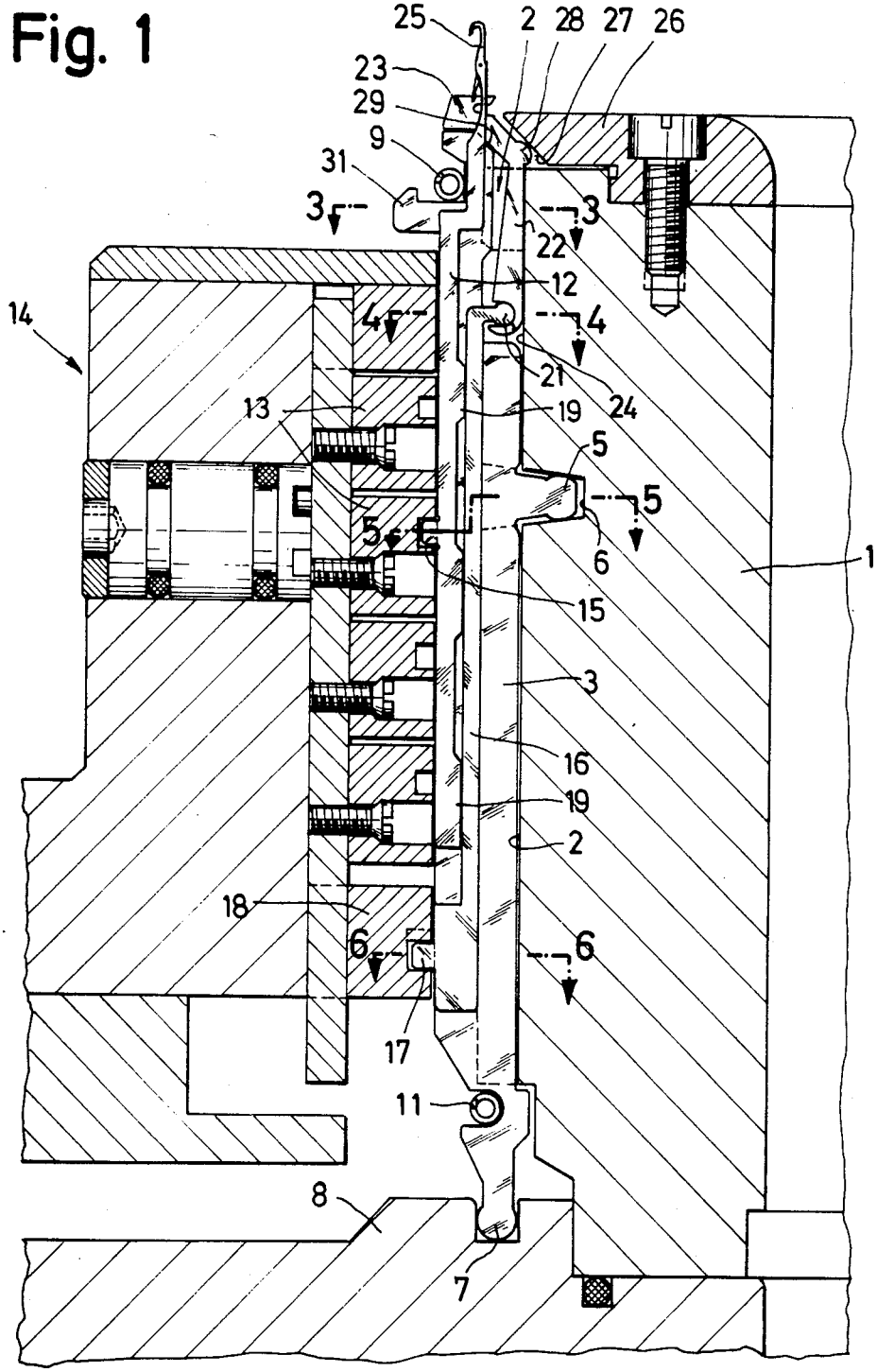
Figure 2:
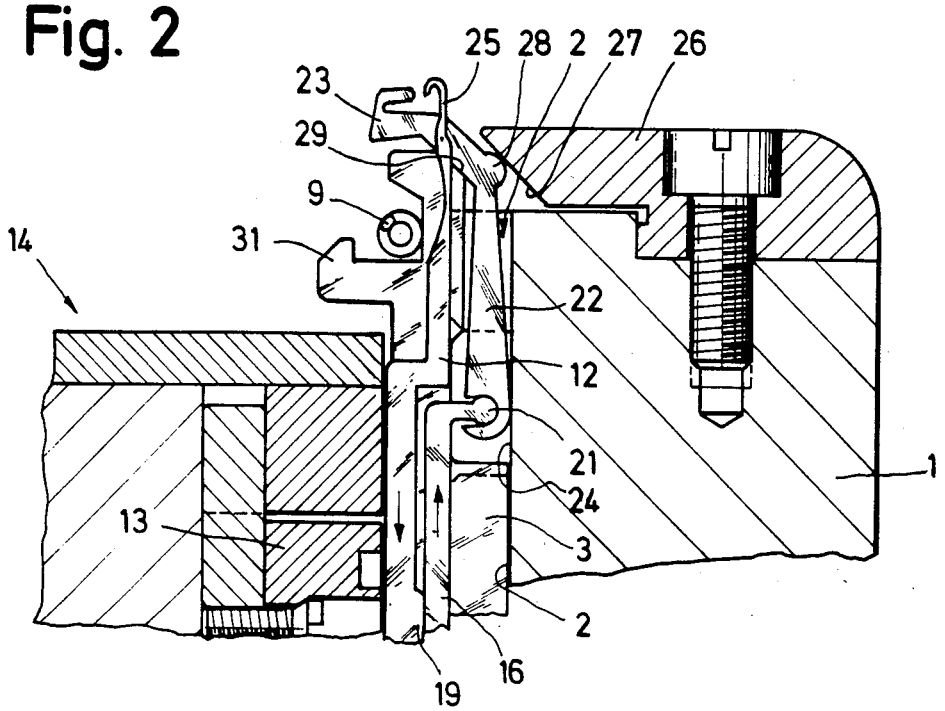
Figure 3:
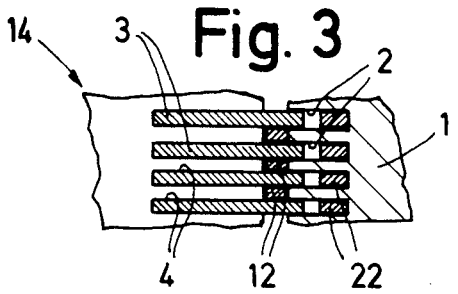

The following description of a preferred embodiment of the invention serves to explain the invention in more detail in conjunction with the attached drawings, in which FIG. 1 is an axial, cross-sectional view of a circular knitting machine having needles and sinkers;

FIG. 2 is an enlarged illustration of the upper region of FIG. 1 showing the needles and sinkers in a different position and FIGS. 3 to 6 are sectional views along the corresponding lines in FIG. 1.

FIG. 1 is an axial view of a needle cylinder 1 of a circular knitting machine of customary construction. The needle cylinder 1 serves as needle support means and its axis extends in fact vertically. Although the invention is described in the following on the basis of a circular knitting machine, it may also be used on all other suitable, stitch-forming machines, with which spring beard or latch needles are displaced in a longitudinal direction more or less exactly and individually or together.

Figure 5:
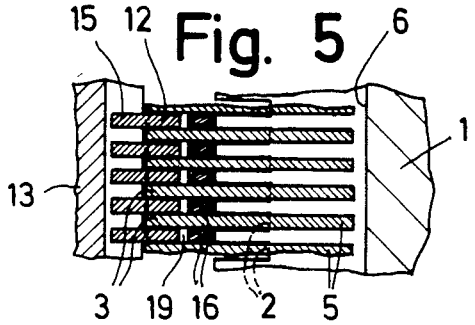
Figure 6:
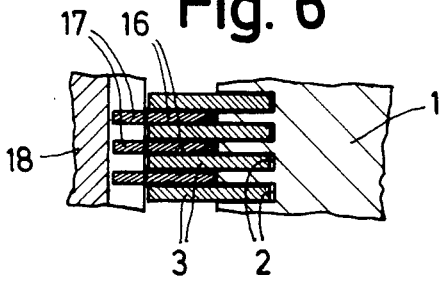

Radially extending, axis parallel grooves or tracks are milled into the outer circumference of the needle cylinder 1—cf. in particular the sectional views in FIGS. 5 and 6. Webs 3, which project radially outwards from the cylinder 1, are secured in these grooves. In this way, slits are formed between the webs 3. In order to be detachably secured to the needle cylinder 1 the webs 3 have noses 5 engaging in corresponding recesses 6 in the cylinder 1. The webs are supported on an annular plate 8 by means of a butt 7. Spiral springs 9, 11 extending around the cylinder 1 serve as additional means for securing the webs 3 to the cylinder 1.

The slits 4 formed between the webs 3 accommodate in the customary manner knitting needles 12 which reciprocate in the longitudinal or axial direction of cylinder 1. The reciprocating movement of the needles 12 is controlled in the known manner by means of cam portions 13 which are components of a cam 14 and engage on needle butts 15 of the knitting needles 12. The embodiment illustrated in FIG. 1 has four superposed cam portions 13. With the aid of four types of needle with varying butt arrangements and with the aid of interchangeable cam portions 13 for floating, tucking and driving out the needles, all known knit patterns may be produced.

The slits 4 between the webs 3 accommodate not only the knitting needles 12 but also push sinkers 16 which reciprocate in the longitudinal direction. The push sinkers are controlled by cam portions 18 via a butt 17. The right-hand edges (as seen in FIG. 1) of the push sinkers 16 rest slidingly on the outer circumference of the needle cylinder 1. The needles 12 have projections 19 on their edges facing away from the butts 15 and these projections rest slidingly on the back or outer edges of the push sinkers 16. The areas of contact between the needles 12 and push sinkers 16, which move independently of each other, are therefore relatively small. Friction is also limited and drive operation requires little power and is also quiet. Needle 12 and its associated push sinker 16 are guided between two adjacent webs 3 reliably and for lateral stability.

Figure 4:
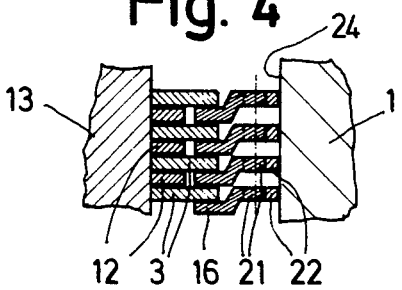

The push sinkers 16 each have at their upper ends a pivot head 21, on which the holding-down and knocking-over sinkers 22 are articulatedly mounted, i.e. for pivoting movement transversely to the direction of movement of the push sinkers 16. As shown in FIG. 4, the pivot heads 21 are offset relative to the shafts of the push sinkers 16 so that the sinkers 22 mounted thereon, and their head portions 23, may each enter between two needles 12. Moreover, the sinkers 22—cf. in particular FIG. 3—are laterally guided and supported in the grooves or tracks 2 which serve, as such, the purpose of accommodating the webs 3. These webs 3 are correspondingly recessed in the area of the sinkers 22—cf. FIGS. 1 and 2—so that a space remains for pivoting movement of the sinkers 22. In the region of the offset pivot heads 21, the needle cylinder 1 is correspondingly recessed in the form of an annular groove 24 (FIG. 2). The sinker heads 23 may move freely between the heads 25 of the needles 12 without rubbing laterally on them.

An annular control claw 26 having an inclined surface 27 is screwed onto the upper edge of the needle cylinder 1. A bulge portion 28 of the sinker 22 rests slidingly against the control surface 27. The webs 3 also have, at their upper ends, inclined control surfaces 29, against which the edges of the sinkers 22 facing away from the bulge portion 28 rest slidingly.

The circular knitting machine described operates in principle as follows: The knitting needles 12 are driven out by the cam portions 13 into their tuck or drive positions and subsequently drawn in or they remain in their floating position. During downward drawing movement of the needles away from their tuck or drive position, the push sinkers 16 are guided by cam portion 18 in the opposite direction (upwards). This (upward) movement of push sinkers 16 is communicated, of course, to the holding-down and knocking-over sinkers 22 connected therewith. As these sinkers 22 are slidingly guided between the control surfaces 27 and 29 this causes them to move transversely and radially outwards as well. Since the knitting surface provided on the sinker 22 thereby moves to a certain extent towards the needle, drawing movement of the needle may be shortened. This leads to the advantages of increased productivity mentioned at the beginning. If one needle 12 selectively remains in its floating position for reasons of knit pattern techniques, this needle does not take up any yarn while the push sinker and the holding-down and knocking-over sinker are moved longitudinally and transversely merely for the purpose of subsequently holding down the knitted fabric when the needle is again driven out.

As illustrated and described, the needles 12 and push sinkers 16 are guided reliably and for lateral stability between the webs 3 whereas the sinkers 22 obtain their lateral stability from their arrangement in the tricks 2 of the needle cylinder 1.

As also mentioned, the webs 3 are detachably secured on the needle cylinder 1 so that the holding-down and knocking-over sinkers 22 may be inserted into the tricks 2 of the needle cylinder or changed once the webs have been removed. For this purpose, the webs 3 are additionally provided with a projection 31, by which the webs 3 may be withdrawn from the tricks 2 by means of a tool (once the cam 14 has been removed).

Instead of having the push sinker 16 bent to the shape of a crank, and its pivot head 21 therefore offset, the sinker may, of course, extend radially in a straight line. In this case, the lower part of the sinker 22 which is mounted on the pivot head 21 must be correspondingly bent to the shape of a crank in the region of the groove 24 in the needle cylinder 1.

What is claimed is:

1. A stitch-forming machine comprising needles guided on a needle support means for longitudinal displacement and controlled by needle cams and also comprising holding-down and knocking-over sinkers which are displaceable between the needles in the region of their heads and are moved by sinker cams in the longitudinal and transverse directions relative to said needle support means, characterised in that a. the sinkers are composed of a push sinker (16) adapted for displacement solely in the longitudinal direction and a holding-down and knocking-over sinker (22) pivotally connected to said push sinker and adapted for displacement in both the longitudinal and transverse directions, that b. the needles (12) and push sinkers (16) are commonly guided between webs (3) on the needle support means (1), said needles thereby resting against the backs of said push sinkers, that c. the pivot connection between the push sinker (16) on the one hand and the holding-down and knocking-over sinker (22) on the other hand is designed and arranged such that said holding-down and knocking-over sinker is disposed between the needles in the region of their heads, that d. a sinker cam in the form of an annular control claw (26) is detachably mounted on the needle cylinder for controlling the holding-down and knocking-over sinker (22), that e. the webs (3) are detachably secured within grooves (2) of the needle support means (1), that f. the webs (3) have inclined control surfaces (29) for controlling the holding-down and knocking-over sinkers (22), and that g. the holding-down and knocking-over sinkers (22) are laterally guided and supported in said grooves (2) accommodating the webs (3), the webs (3) being correspondingly recessed in the area of the sinkers (22) to form a space for the pivoting movement of the sinkers (22).

2. Machine as defined in claim 1, characterized in that the push sinker (16) has at the pivot connection a pivot head (21) bent to the shape of a crank.

3. Machine as defined in claim 1, characterized in that the webs (3) have projections (31) for removal of the webs from the needle support means (1).

4. Machine as defined in claim 1, characterized in that the needles (12) have projections (19) on their shafts which rest slidingly against the push sinkers (16).

* * * * *